United States Patent [19]

Manty et al.

[11] 4,236,940

[45] Dec. 2, 1980

[54] WEAR RESISTANT TITANIUM ALLOY COATING

[75] Inventors: Brian A. Manty, Lake Park; Herbert R. Liss, Stuart; Henry Lada, Lake Park, all of Fla.

[73] Assignee: United Technologies Corporation, Hartford, Conn.

[21] Appl. No.: 47,666

[22] Filed: Jun. 12, 1979

Related U.S. Application Data

[63] Continuation-in-part of Ser. No. 884,294, Mar. 6, 1978, abandoned.

[51] Int. Cl.[3] ..... C23B 5/52

[52] U.S. Cl. ..... 148/6.2; 148/31.5; 204/29; 204/37 R; 427/328; 427/383.9

[58] Field of Search ..... 204/29.32 R, 37 R; 134/41; 427/383 D, 383.9, 328; 148/6.2

[56] References Cited

U.S. PATENT DOCUMENTS

| | | | |
|---|---|---|---|
| 2,825,682 | 3/1958 | Missel | 204/29 |
| 2,829,091 | 4/1958 | Missel | 204/29 |
| 2,858,600 | 11/1958 | Vigor | 427/383 D |
| 3,439,188 | 4/1969 | Glover | 204/37 R |
| 3,560,274 | 2/1971 | Ogden | 204/37 R |
| 3,691,029 | 9/1972 | Raymond | 204/37 R |

OTHER PUBLICATIONS

Metal Finishing Guide Book and Directory for 1975, Metals and Plastics Pub. Inc., Hackensack, NJ, pp. 72, 73.

*Primary Examiner*—Ralph S. Kendall
*Attorney, Agent, or Firm*—Charles G. Nessler

[57] ABSTRACT

The adherence and wear resistance of chromium alloy electroplates on titanium is improved by pretreating the substrate to form a chromium conversion coating, and post-treating the substrate at a temperature at about 700–820° C. (1300–1500° F.) for about 1–300 hours. The pretreatment is comprised of the formation of a chromium conversion coating from an acid chromate solution; a preferred solution is comprised of hydrofluoric acid, sodium chromate, and water. The post treatment causes diffusion sufficient to obtain a bond but avoids completely interdiffusing the chromium alloy electroplate, to preserve the wear resistance of the electroplate surface.

5 Claims, No Drawings

WEAR RESISTANT TITANIUM ALLOY COATING

The Government has rights in this invention pursuant to Contract No. N00019-76-C-0342, awarded by the Department of the Navy.

CROSS REFERENCE TO RELATED APPLICATION

This application is a continuation-in-part of Ser. No. 884,294, filed Mar. 6, 1978, now abandoned.

BACKGROUND OF THE INVENTION

1. Field of the Invention

The present invention relates to the electroplating of chromium and chromium alloy coatings on titanium substrates and, more particularly, to surface preparation and post-electroplating techniques for promoting adherence of such electrodeposits to the titanium substrate surface.

2. Description of the Prior Art

Titanium alloys have been extensively used in gas turbine engines for over two decades as a result of their favorable strength-to-weight ratios. As gas turbine engine technology has advanced over the years, the demands placed on these alloys have become increasingly severe and it has been necessary to provide titanium with suitable coatings to alleviate such potential problems as erosion, corrosion, fretting and galling. A coating system found to fulfill these and other requirements for a successful coated titanium article is a chromium coating containing a relatively small but effective amount of molybdenum. In general, molybdenum in amounts up to about 5 weight percent has proved effective in increasing wear resistance and corrosion resistance of the coating. Usually, the molybdenum content selected depends upon the particular properties desired in view of the intended service application of the coated article. Generally, increasing coating ductility will be evident with increasing molybdenum content with the actual maximum molybdenum content being determined by the wear and oxidation corrosion resistance required. Excessive quantities of molybdenum can be expected to result in poor oxidation characteristics.

Although the chromium molybdenum coating can be deposited on titanium substrates by a number of methods, including pack and slurry techniques, vapor deposition and sputtering, a particularly convenient method involves electrodeposition from an aqueous bath containing conventional chromium plating salts (for example, $CrO_3$) and, in addition, a source of dissolved molybdenum such as molybdic acid, sodium molybdate and ammonium molybdate. Small amounts of a catalyst, typically sulfate ions, are also present in the bath. A problem associated with the electrodeposition of chromium alloys on titanium substrates has been one of suitable adhesion of the asdeposited coating to the substrate surface. Another problem is that interdiffusion of the chromium alloy deposit with the substrate during any heat treatment can affect both the wear resistance and mechanical properties of the article.

Prior art workers have devised various approaches to obtaining advantageous results as reflected in various U.S. patents. Glover et al., U.S. Pat. No. 3,439,188, discloses solvent cleaning and grit blasting, when copper plating with the aid of ultrasonics, followed by heat treatment in the 1650°–1725° F. (900°–930° C.) range. Missell et al., U.S. Pat. No. 2,825,682, discloses pretreatment by forming a chromium conversion coating. Ogden, U.S. Pat. No. 3,560,274, discloses a pretreatment of chemical polishing; deposit of a relatively thin layer; and, posttreatment by diffusion annealing at temperatures of 1600°–1900° F. (870°–1140° C.), whereby complete diffusion was achieved. Raymond, U.S. Pat. No. 3,691,029, discloses a two-step process wherein a first thin plating is diffusion bonded at 1600°–1900° F. (870°–1140° C.), and followed by further electroplating.

In electrodepositing chromium molybdenum and other alloy coatings on titanium substrates, it has been recognized that, ideally, the substrate surface should be clean, free of interface contamination and activated so that the electrodeposit will adhere without further treatment. Unfortunately, titanium is not easily activated and maintained for any extended period of time in that condition as a result of its rapidly forming oxides. The most sophisticated surface conditioning treatments, such as conversion of the surface to hydrides or complexing the surface with tartrates to minimize oxide formation, have not resulted in satisfactory bond strengths. Other treatments such as abrading while plating or inert atmosphere plating have not significantly improved the results. For high performance gas turbine engine applications, it has been demonstrated that suitable adhesion in the service environment cannot be obtained without a diffusion heat treatment after plating. Of course, it is well known that heat treating titanium alloy substrates, particularly alloys such as Ti-6Al-2Sn-4Zr-2Mo, can alter their mechanical properties by metallurgical changes and alleviation of desirable residual stresses. Thus, it is preferred to have a hardfacing method which avoids higher temperatures.

Further, it is undesirable to use a method which uses sandblasting since grits thereby become embedded in the substrate surface. However, light blasting often may not by itself give adequate preparation. And chemical polishing is not particularly desirable when fine dimensions are being maintained.

SUMMARY OF THE INVENTION

An object of the present invention is to provide an improved method for obtaining more wear resistant coatings on titanium substrates, with the minimum adverse effect on the substrate.

According to the invention, a wear resistant coating is achieved by a combination of steps. A substrate is lightly cleaned and a chromium conversion coating is applied. After an electrodeposit of chromium alloy is applied, the coated substrate is heat treated at a relatively low temperature, sufficient to obtain a good bond, but insufficient to cause excess diffusion of the chromium alloy, and inadequate wear resistance.

In the preferred embodiment of the invention, the part is first vapor blasted with silica and then a chromium conversion coating is applied using a hydrofluoric acid, sodium chromate, and water solution. Next a chromium molybdenum alloy is electrodeposited. Then the article is heat treated at a temperature less than about 800° C. (1500° F.).

The invention provides a pretreatment capable of imparting sufficient adhesion to hold the as-deposited coating on the substrate during normal handling and until a subsequent diffusion heat treatment can be performed to metallurgically bond the coating to the substrate. The invention further provides superior wear resistance to a titanium substrate compared to the prior art processes, and minimizes the adverse effects on the substrate.

DESCRIPTION OF THE PREFERRED EMBODIMENT

The present invention comprises an improved pretreatment and posttreatment which is especially useful in the application of chromium molybdenum alloys to titanium substrates. It will be seen to be useful with plain chromium and other metal alloys as well. The titanium alloys for which the invention is useful are presented in Table I.

TABLE I

| | Weight Percent Composition of Titanium Alloys; Balance is Titanium | | | | |
|---|---|---|---|---|---|
| Name | Al | V | Sn | Zr | Mo |
| Ti-6-4 | 6 | 4 | — | — | — |
| Ti-8-1-1 | 8 | 1 | — | — | 1 |
| Ti-6-6-2 | 6 | 6 | 2 | — | — |
| Ti-6-2-4-2 | 6 | — | 2 | 4 | 2 |
| Ti-6-2-4-6 | 6 | — | 2 | 4 | 6 |

As mentioned in the background, and as reflected by the previous art, obtaining useful platings on the aforementioned alloys has not been easy and obvious or simple combinations of steps do not always work. This will be illustrated in the following description which comprises placing a chromium/1–2% molybdenum alloy surface on Ti-6-4 alloy.

Generally, plating over a wet abrasive blasted surface has been found to work satisfactorily, but the substrate surface had to be kept wet between vapor blasting and plating and occasionally, for no apparent reason, localized passivation of the substrate prevented electrodeposition of the chromium coating. Grit blasting with from 80 to 240 grit silicon carbide prior to plating resulted in excellent adhesion of the chromium molybdenum electrodeposits. The problem with this pretreatment is that abrasive particles embed themselves into the titanium surface, resulting in excessive interface contamination. These abrasive particles not only interfere with any subsequent diffusion treatment, but also reduce the life of the coating during wear testing.

In accordance with the present invention, an optimum surface conditioning treatment for consistently satisfying the coating adherence requirement involves the formation of a chromium conversion coating on a cleaned titanium substrate prior to electrodeposition. The preferred method involves wet abrasive blasting of the substrate surface with a slurry of metal oxide, (such as novaculite, Novasite 200 of Malvern Minerals Co., Hot Springs, Ark.) at a sufficient pressure, such as 0.4–0.7 $MN/m^2$ (50–100 psig) air pressure, to remove foreign matter and oxide from the surface. Other cleaning techniques which may find use in the invention are degreasing in alkali, pickling in $HNO_3/HF$ solutions, molten salt descaling or any other methods known to the industry. After vapor blasting, the substrate is rinsed in clean water and preferably is kept wet prior to the chromium conversion treatment. The chromium conversion treatment is satisfactorily effected with an acid chromate solution comprising 1–3 volume percent hydrofluoric acid, 7.5–15 g/l (1.0–2.0 oz/gal) sodium chromate ($Na_2CrO_4$), balance water at ambient temperature. A convenient method for providing contact between the substrate surface and acid chromate solution is by simple immersion of the substrate therein, for example, immersion times of 5–15 seconds being satisfactory. Of course, the coating will be very thin, typically less than about 0.0025 mm (0.0001 inch).

Of course, other means such as spraying, painting and the like may also be used to effect contact between the chromate solution and the surface. Those skilled in the art will also recognize that the acid chromate bath may comprise other well-known ingredients of equivalent effect, such as dichromate salts or chromic acid in lieu of or in addition to chromate salts, and also other possible concentrations of the ingredients. As used herein, chromium conversion coating treatment includes the reaction produced when the titanium substrate is exposed to the acid chromate solution, this reaction usually being in the form of titanium being galvanically replaced by chromium which adheres to the surface of the substrate. Electron microprobe analysis of an acid chromateimmersed substrate will confirm the presence of chromium on the surface. Various acid chromate solutions are capable of producing these products and are of course useful in the invention.

The acid chromate treated substrate is then rinsed in water to remove excess solution and preferably is kept wet prior to electroplating. Electroplating of the chromium molybdenum alloy coating can be effected conveniently in a conventional, self-regulating chromium plating bath containing a source of dissolved molybdenum such as molybdic acid, sodium molybdate and ammonium molybdate. In a bath comprising 263–338 g/l (35–45 oz/gal) chromic acid ($CrO_3$) 75 g/l (10 oz/gal) ammonium molybdate, balance water, a current density of 24–47 ASD (1.5–3 ASI) is satisfactory. The current is maintained until the desired thickness of chromium molybdenum coating is achieved. For most applications, an electroplate of about 0.013 to 0.076 mm (0.0005 to 0.003 inch) is satisfactory. Upon removal from the electroplate bath, as a result of the pretreatment, it is found that the electroplated substrate can be readily handled without a loss of coating adhesion.

The electroplated substrate is next heat treated to obtain a diffusion bond between the substrate, the conversion coating, and the chromium molybdenum electroplate. It is not an object, as results intentionally or inevitably in the prior art, to completely interdiffuse the coating with the substrate. That is, the surface desired is a chromium molybdenum alloy; not an alloy also containing titanium.

As reflected in the following discussion, it has been discovered that the temperature of heat treatment should be in about the 700°–820° C. (1300°–1500° F.) range. This was established through wear resistance tests. The evaluation used was a Falex Wear Test, in accord with ASTM D-2625, wherein Ti-6-4 pins having a coating applied as described above, are rotated in forceful contact with AlS1 1137 alloy steel blocks. The tests were run without lubrication, until the friction increased to the point where the pins fractured in trosion, or until 3 minutes passed, whereupon the load on the steel blocks was incrementally increased after each 1 minute periods.

The test data are shown in Table 2. it can be seen that Specimens A and B failed before the steel blocks were loaded to their initial test level, 135 kg. Specimen C was slightly improved, but great improvement was observed for Specimens D and E. It was concluded that temperatures above 870° C. (1600° F.) were to be avoided, as there most likely is too great interdiffusion of the substrate and coating, with deleterious effects on wear resistance. The great advantage of the lower 760° C. (1400° F.) heat treatment is seen. This temperature is adequate to obtain the desired bonding between the coating layers and the substrate, but insufficient to degrade the inherent wear properties of the chromium molybdenum alloy surface. The second step heat treatment of Specimen E at 600° C. (6 hrs.) seems to give some further improvement, though the data are admittedly limited.

TABLE II

Effect of Heat Treatment on Wear Resistance of Chromium Molybdenum Coated Ti-6Al-4V

| Specimen | Heat Treatment Temp/Time | Load kg | Duration min. |
|---|---|---|---|
| A | 970° C. (1hr) +600° C. (8hr) | Failed at less than 135 kg | |
| B | 870° C. (1hr) | Failed at less than 135 kg | |
| C | 870° C. (1hr) +600° C. (6hr) | 135 | 0.51 |
| D | 760° C. (3hr) | 135 | 3 |
| | | 225 | 1 |
| | | 340 | 0.53 |
| E | 760° C. (3hr) +600° C. (6hr) | 135 | 3 |
| | | 225 | 1 |
| | | 340 | 1 |
| | | 455 | 1.63 |

Of course, there is an interdependency between time and temperature in heat treatment of metals. It is well known that temperature is the more powerful variable; one well-known rule of thumb is that a 10° C. increase in temperature has the same effect as a doubling of time. Thus, the longer 3-hour time of the 760° C. heat treatment is not significant compared to the lowering of the temperature from the 870° C. range of the prior art. Although acquisition of further data was not possible, it is reasonably believed that the temperature may be varied from the 760° C. level. Based on the apparent effectiveness of the 600° C. second step treatment in Specimens C and E, lower temperatures, at least to 700° C. (1300° F.), will be usable. The interdiffusion will be lowered by a lowering of temperature. But of course the time may be increased in partial or total compensation, up to 300 hours, according to the rule of thumb above. Similarly, it would appear that temperatures intermediate 760° C. and 870° C. would be usable, although the results may be less optimal than those at 600° C. Thus, it is reasonably believed a temperature of about 820° C. (1500° F.) would be satisfactory to practice the invention. Within the foregoing context, the time is somewhat nominal. For the higher end of the 700°–820° range, temperatures of the order of one hour would appear usable, while at the lower end, very long times of the order of 300 hours are indicated; but of course, economic considerations would probably limit times to lesser durations, say of the order of 50–100 hours. As is common for titanium, a vacuum or inert atmosphere should be used for all heat treatments.

The aforementioned invention temperature ranges will be particularly useful for advanced titanium alloys. By way of example, the alloy Ti-6-2-4-6 has a preferred solution heat treatment of 845°–915° C. (1550°–1675° F.)/(1 hr) followed by a precipitation treatment of 595° C. (1100° F.)/(4–8 hrs). Thus, according to the invention, it is possible to apply a coating without intruding into the important solution temperature range. The exact processing of such a complex alloy naturally requires careful study. But, the capability of achieving adherent but still wear resistant coatings on such alloys adds a new dimension of flexibility and further their use.

Although this invention has been shown and described with respect to a preferred embodiment, it will be understood by those skilled in this art that various changes in form and detail thereof may be made without departing from the spirit and scope of the claimed invention.

Having thus described a typical embodiment of our invention, that which we claim as new and desire to secure by Letters Patent of the United States is:

1. The method of providing a wear and corrosion resistant coating on a titanium alloy substrate, comprising:

exposing clean substrate;

applying as a first layer an acid chromate solution to the clean substrate to form a chromium conversion coating thereon;

depositing as a second layer a chromium base coating on the chromium conversion coated substrate; and heat treating the coated substrate at about 700°–820° (1300°–1500° F.) for 1–300 hours to metallurgically bond the coatings and substrate, without completely interdiffusing said second layer chromium base coating into the substrate, to preserve the wear resisting properties of the second layer surface.

2. The method of claim 1 wherein the step of exposing clean substrate is comprised of aqueous vapor blasting, wherein the acid chromate solution is an aqueous solution of hydrofluoric acid and a chromate salt, and wherein the chromium base coating is a chromium molybdenum alloy deposited by electroplating.

3. The method of claim 2 wherein the heat treatment of the coated substrate is at about 760° C. (1400° F.) for about 3 hours.

4. The method of claims 2 or 3 further comprising a second heat treatment step at about 600° C. for 6 hours.

5. An article produced by the method of claim 2.

* * * * *